United States Patent [19]

Wilber

[11] Patent Number: 4,795,367

[45] Date of Patent: Jan. 3, 1989

[54] WAND CONTROL FOR ELECTRONIC CIRCUITS

[76] Inventor: Stanley D. Wilber, Rte. 1, Box 1283, Foley, Ala. 36535

[21] Appl. No.: 118,072

[22] Filed: Nov. 9, 1987

[51] Int. Cl.[4] ..... H01R 13/00; H01H 35/00

[52] U.S. Cl. ..... 439/481; 200/52 R

[58] Field of Search ..... 200/DIG. 2, 153 R, 157, 200/243, 329, 6 A, 52 R; 439/49, 481, 482; 273/148 B; 340/365 C, 365 R, 709, 712; 178/18, 19, 20

[56] References Cited

U.S. PATENT DOCUMENTS

| | | | |
|---|---|---|---|
| 2,241,544 | 5/1941 | Dreyer, Jr. | 178/20 X |
| 4,303,812 | 12/1981 | Kapadia et al. | 200/243 X |
| 4,394,548 | 7/1983 | Dola | 200/6 A |

*Primary Examiner*—Steven Mottola

*Attorney, Agent, or Firm*—Henderson & Sturm

[57] ABSTRACT

Disclosed is an XY controller made up of a base and a seperate wand. The base has a flat top on which are arranged four separate electrical conductor strips in a square pattern except that the strips do not meet at the corners of the square but are closely spaced apart to provide normally open switches. The strips are individually connected to the data buss, for example, of an electronic apparatus such as a computer, game, etc. The wand is also connected to the apparatus and is freely manipulable manually relative to the base to make electrical contact with any strip or, selectively, with neighboring strips at each corner of the square, thereby to close the selected switch. Thus, manipulation of the wand, movable up and down, cross-wise and diagonally effects corresponding actuation of the circuits in the apparatus. The connection of the wand to the apparatus includes a line serving as a tether to the base.

6 Claims, 1 Drawing Sheet

Fig. 1
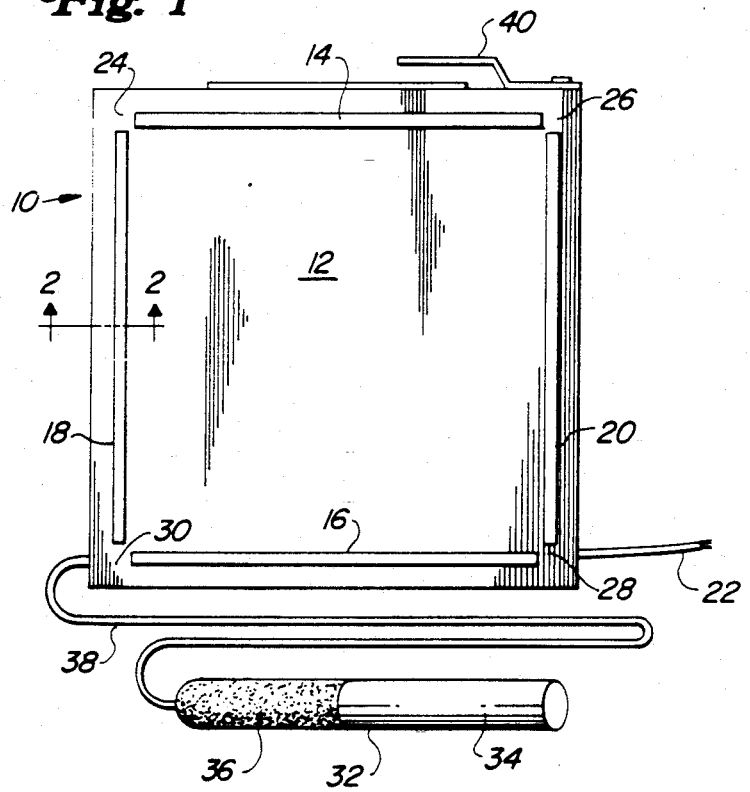
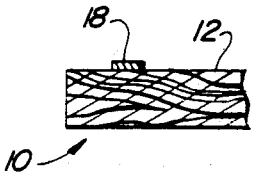
Fig. 2
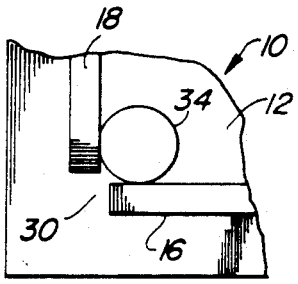
Fig. 3

WAND CONTROL FOR ELECTRONIC CIRCUITS

BACKGROUND AND SUMMARY OF THE INVENTION

Joysticks of the swivel or universal type are of course well known for effecting many types of controls, including the circuits in electronic apparatus such as computers, electronic games, etc. Known structures are relatively complex and correspondingly costly to manufacturer, use and maintain. According to the present invention, a very much simplified, low-cost controller is provided, comprising but two moving parts, one of which is a nonconductor base having a flat top to which, in a preferred embodiment of the invention, four electrical conductor strips are arranged in a square pattern in which the strips do not meet at the corners of the square but instead are respectively closely spaced apart to afford what may be termed normally open switches. The strips are connected individually to the data buss of the apparatus in any know manner.

A wand, having a conductor end portion, is also connected to the apparatus and is used to contact any one of the strips to provide up and down (NS) or crosswise (EW) control of the apparatus components. The wand is also used to bridge across the space between neighboring strips at any corner of the square pattern and thus enables diagonal control of the apparatus components.

In a typical arrangement, the electric potential will be in the millivolt range and little if any insulation is required, thus further simplifying and reducing the cost of the device. In a preferred embodiment, the electrical connection of the wand to the apparatus includes a tether of the wand to the base so as to achieve ready availability of the wand.

Further features and advantages of the invention will appear from the ensuing description and accompanying drawings.

DESCRIPTION OF THE DRAWINGS

FIG. 1 is a face view of the control structure.

FIG. 2 is a partial section on the line 2—2 of FIG. 1.

FIG. 3 is a fragmentary plan view of one corner of the square pattern and showing the wand in strip-bridging mode.

DETAILED DESCRIPTION OF A PREFERRED EMBODIMENT

OF THE INVENTION

The structure includes a base (10) which may be of any shape but is here shown as a square for convenience and appearance. The base hase a flat or planar top surface (12) and is made of nonconductor material, which may be wood, for example. Secured to the top surface in any suitable manner are four electrical conductor strips (14), (16), (18) and (20), which may be of copper. The numeral (22) designates a cable including a plurality of electrical leads by means of which the strips are separately connected to the data buss, for example, of the electronic apparatus (not shown) which may be of any type; e.g., computer, electronic game, etc. The connections of the strips to the cable are not shown, because these may be of any known nature.

The four strips are arranged in a planar geometric pattern, such as rectangular or more specifically a square, thus having four corners at which neighboring strips do not meet but are closely spaced apart so as to provide what may be termed normally open switches (24), (26), (28) and (30). A further part of the structure is a wand (32) having a conductor end portion (34) of such dimension as to be capable of bridging across neighboring strips at any corner of the pattern, as best seen in FIG. 3. The wand is preferably formed of copper tubing of suitable diameter and a portion of it is wrapped a with electrical tape to provide an insulated handle part (36). The wand is also electrically tied into the data buss as by a lead (38) which is connected to and extends through the base and to the apparatus by way of the cable (22). In the present case, the lead (38) serves also as a tether to prevent loss of the wand from the base. The lead is of course sufficiently long and flexible to permit free manual movement of the wand crosswise, up and down and diagonally as respects the square pattern.

It will be clear frm the foregoing that the wand may be used to contact any one of the strips so as to achieve XY control of the apparatus, since wand-strip contact effects closing of an electrical circuit in the apparatus. As seen in FIG. 3, the wand may also be used to close the switch between neighboring strips at the respective corners of the pattern. In FIG. 3, for example, the wand bridges the strips (16) and (18) to close the switch (30). Like results obtain at the other corners of the pattern according to movement of the wand, thus producing diagonal control of the apparatus components.

As an adjunct to the structure, there may be included a "telegraph key" type of control as at (40), which is also wired in to the apparatus to be controlled. The wand could be used to effect closing of this switch if desired.

In the preferred embodiment of the invention, the square pattern is substantially five by five inches but could be of any size, that selected being found to be convenient and inexpensive. The inventive control is simple to make and use. It is inexpensive and extremely unlikely to require servicing. Features and advantages other than those pointed out will be apparent to those versed in the art, as will many modifications of the embodiment disclosed, all without departure from the spirit and scope of the invention.

I claim:

1. A control system for use with an electronic apparatus, comprising a nonconductor base having a planar surface, a plurality of electrical conductors adapted for connection to the apparatus and carried by the base surface in a planar geometric pattern including a plurality of incomplete corners in which each conductor is closely spaced from its neighbor at each corner of the pattern so that the corners provide a plurality of normally open switches, and a wand relatively freely movable manually relative to the base and adapted for electrical connection to the apparatus, the wand including a conductor end portion manually selectively operative to electrically contact any one of the conductors and also so dimensioned as to be capable of bridging the space between selected neighboring conductors and thus to close the switch at the selected corner.

2. The control system according to claim 1, including a tether connecting the wand to the base.

3. The control system according to claim 2, in which the tether includes an electrical lead as part of a connection of the wand to the apparatus.

4. The control system of claim 1, in which a portion of the wand is insulated from its conductor end portion so as to provide a handle.

5. The control system of claim 1, in which the pattern is a rectangular providing four corners and thus four normally open switches.

6. The control system of claim 1, in which the pattern is a square providing four corners and thus four normally open switches.

* * * * *